US008093565B2

(12) United States Patent
Herrero et al.

(10) Patent No.: US 8,093,565 B2
(45) Date of Patent: Jan. 10, 2012

(54) WIND AND TEMPERATURE SPECTROMETER WITH CROSSED SMALL-DEFLECTION ENERGY ANALYZER

(75) Inventors: Federico A. Herrero, Glenn Dale, MD (US); Theodore T. Finne, Arlington, VA (US)

(73) Assignee: The United States of America as represented by the Adminstrator of the National Aeromautics and Space Administration, Washington, DC (US)

( * ) Notice: Subject to any disclaimer, the term of this patent is extended or adjusted under 35 U.S.C. 154(b) by 165 days.

(21) Appl. No.: 12/695,478

(22) Filed: Jan. 28, 2010

(65) Prior Publication Data

US 2011/0180700 A1 Jul. 28, 2011

(51) Int. Cl.
*H01J 49/02* (2006.01)
*H01J 49/44* (2006.01)

(52) U.S. Cl. ..... 250/397; 250/299; 250/396 R; 250/281; 250/282

(58) Field of Classification Search ..... 250/221, 250/222.2, 281, 282, 299, 396 R, 39
See application file for complete search history.

(56) References Cited

U.S. PATENT DOCUMENTS

| | | | | |
|---|---|---|---|---|
| 3,000,833 | A * | 9/1961 | Coleman et al. | 252/587 |
| 7,372,021 | B2 * | 5/2008 | Cotter et al. | 250/287 |
| 2004/0256549 | A1 * | 12/2004 | Bowdler et al. | 250/287 |
| 2007/0029474 | A1 * | 2/2007 | Cotter et al. | 250/287 |
| 2011/0032496 | A1 * | 2/2011 | Shibazaki | 355/30 |

* cited by examiner

*Primary Examiner* — Bernard E Souw
(74) *Attorney, Agent, or Firm* — Christopher Edwards

(57) ABSTRACT

A wind and temperature spectrometer (WTS) may detect the angular and energy distributions of neutral atoms/molecules and ions in two mutually perpendicular planes. The measured energy distribution at a known angle near the peak may be used to infer the full wind vector W. A WTS having a single ion source may be used in conjunction with a crossed small-deflection energy analyzer (SDEA). The crossed SDEA may combine the angular and energy distributions in the two mutually perpendicular planes into a single spectrometer with a single optical axis. A WTS having a single ion source may use less energy and occupy less space than a WTS with two ion sources.

16 Claims, 10 Drawing Sheets

WIND AND TEMPERATURE SPECTROMETER WITH CROSSED SMALL-DEFLECTION ENERGY ANALYZER

ORIGIN OF INVENTION

The invention described herein was made by employees of the United States Government, and may be manufactured and used by or for the Government for governmental purposes without the payment of any royalties thereon or therefor.

FIELD OF THE INVENTION

The present invention relates to wind and temperature spectrometers that may be used, for example, for measurements of neutral wind and ion drifts in the Earth's thermosphere and ionosphere. The invention may also be used to obtain the temperature of the thermosphere and ionosphere, and the relative densities of their major constituents, such as O and $N_2$, or $O^+$ and $NO^+$.

BACKGROUND

The determination of neutral winds and ion drifts in low-Earth orbits may require measurements of the angular and energy distributions of the flux of neutrals and ions entering a satellite from the ram direction. The ram direction may be the direction of the average or total velocity T of the air stream passing aperture 10 as shown in FIG. 1. The lower portion of FIG. 1 shows a simulation of the angular distribution of the flux F (atomic oxygen is shown) entering an aperture 10 of a spectrometer. The angular distribution of the flux F is shown with respect to two mutually perpendicular axes tau and theta. The angular distribution of the flux F may be generally confined within a cone roughly centered along the ram axis A (direction of satellite movement) and generally azimuthally symmetric. The orientation of the aperture 10 may not necessarily coincide with A.

The average total velocity T of the air is the sum of the satellite velocity S and the wind vector W. The magnitude and direction of the neutral wind (or ion drift) vector W determines the location of the maximum in the angular distribution of the flux F. Knowledge of the angle of maximum flux with respect to the satellite's coordinates, and the satellite's pointing with respect to S, may be used to determine the wind (or ion drift) vector W.

Spectrometers may detect the angular and energy distributions of neutral atoms/molecules and ions in two mutually perpendicular planes. A small-deflection energy analyzer (SDEA) is described in "The Gated Electrostatic Mass Spectrometer (GEMS): Definition and Preliminary Results"; F. A. Herrero, H. H. Jones, J. G. Lee; Journal Of American Society for Mass Spectrometry 2008, 19, pp. 1384-1394, Jul. 18, 2008, which is expressly incorporated by reference in its entirety herein. On page 1388 of the cited article, it is noted that the exit slit may be laid out in a circular arc spanned by an angle, such as theta or tau, so that all trajectories have the same length along the SDEA. For measurements along two mutually perpendicular planes, such as the planes spanned by the axes tau and theta of FIG. 1, separate spectrometers and ion sources may be used for the measurements along each of the two mutually perpendicular planes. Each ion source may require electric power and may occupy a certain volume. A need exists for a spectrometer that uses less electric power and occupies less space.

SUMMARY

In one aspect, a wind and temperature spectrometer (WTS) may include a crossed SDEA that may provide detection in two mutually perpendicular planes.

A crossed SDEA may include eight plates defined by the intersection of a first pair of parallel planes spaced apart a distance D with a second pair of parallel planes spaced apart the distance D and a hemisphere having a center and a great circle. The first and second pairs of parallel planes may be perpendicular to each other and to the great circle, and may be arranged symmetrically about the center of the hemisphere.

An aperture member may be located adjacent and spaced apart from the great circle. The aperture member may define an entrance aperture that is centered on a line that is perpendicular to the plane of the great circle and that intersects the center of the hemisphere.

An exit slit member may be spaced apart from a curved surface of the hemisphere. The exit slit member may include an exit slit defined by the intersection of a pair of perpendicular planes with a curved surface of a second hemisphere that is concentric with the hemisphere. The second hemisphere may have a great circle that is coplanar with the great circle of the hemisphere, and a radius that is larger than a radius of the hemisphere. One of the pair of perpendicular planes may be parallel to the first pair of parallel planes. The line of intersection of the pair of perpendicular planes may be parallel to and offset from a line that contains the center of, and is normal to, the great circle of the hemisphere.

A detector plate may be located adjacent and spaced apart from the exit slit member. The detector plate may be in a plane parallel to the plane of the great circle of the hemisphere.

The crossed SDEA may be included in a WTS. The WTS may also include a second aperture member that defines an entrance aperture for the WTS, and a single ion source ionizer chamber disposed downstream of the second aperture member.

A method of measuring neutral winds and ion drifts may include providing a crossed SDEA, and detecting angular and energy distributions of ions passing through the crossed SDEA. The detecting may include detecting in two mutually perpendicular planes. The ions may be produced using a single ion source ionizer chamber.

The method may include alternating the voltage applied to plates of the SDEA. In addition, the magnitude of the alternated voltage may be varied to produce an energy spectrum.

Further features and advantages of the invention will become apparent from the following detailed description taken in conjunction with the following drawings.

DETAILED DESCRIPTION

Figure 1:
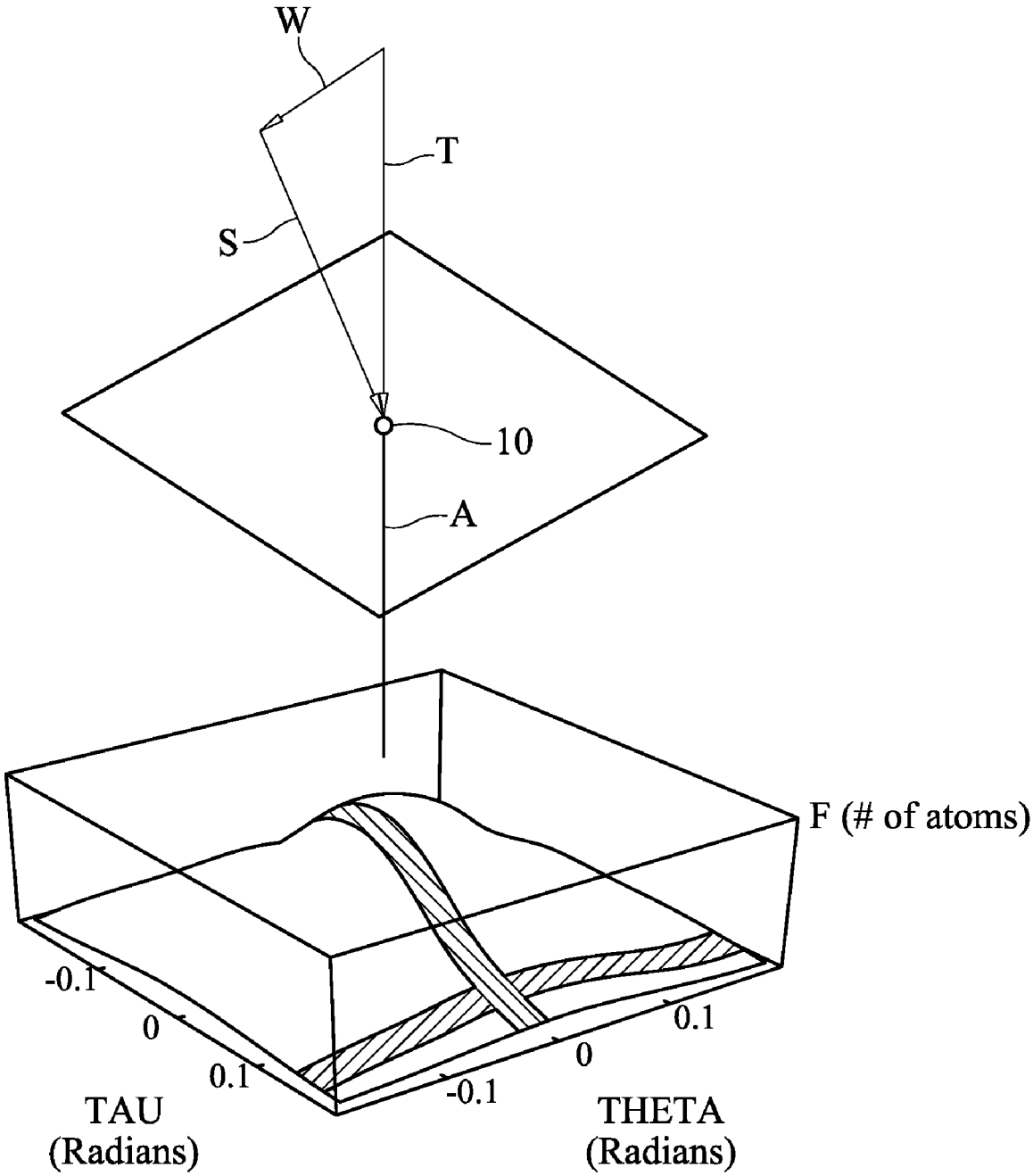
FIG. 1 shows a simulation of the angular distribution of the flux entering an aperture of a spectrometer.

To obtain the wind vector W as discussed with FIG. 1, two semi-circular SDEAs may be used to measure the angular distributions along the two mutually perpendicular planes spanned by theta and tau (shown by the hatched areas on the flux function F). Thus, a WTS may have two separate SDEAs to sample the two-dimensional angular distribution of the flux along two perpendicular planes, and thereby infer the angle of maximum flux. However, each of the SDEAs may require its own ion source to detect and analyze the neutral atoms and molecules.

Rather than use two, separate, semi-circular SDEAs, a WTS may use a crossed SDEA to measure the angular distribution along two perpendicular slices of the angular distribution shown in FIG. 1. The crossed SDEA described herein may merge two SDEAs so that the two SDEAs share a common optical axis. Measurements may be alternated between the two perpendicular planes to reduce the footprint of the full instrument and reduce the number of ion sources from two to one. As in the case of two semi-circular SDEAs, the measured energy distribution at a known angle near the peak may be used to infer the full wind vector W. The same procedure may also be used to obtain the ion-drift vector. The temperatures (neutral or ion) and relative densities of some of the species may be obtained using the process of least squares fitting of the data to the flux function.

A WTS having a crossed SDEA may occupy minimal volume and consume minimal power. The WTS may be designed for upper atmosphere/ionosphere investigations at Earth altitudes above 100 km. The WTS may operate by detecting the angular and energy distributions of neutral atoms/molecules and ions in two mutually perpendicular planes. The two detection planes may cross at the spectrometer center, thereby enabling use of a single ion source for wind/temperature measurements. Use of a single ion source may reduce the required electrical power by half. In addition, the reduction in the volume of the WTS may benefit both neutral and ion measurements in the upper atmosphere.

The crossed SDEA may combine the two angular distributions into a single spectrometer with a single optical axis. This combination may minimize the volume and footprint of the WTS significantly and may reduce the ion source power by a factor of two. Ultimately, the size of a spectrometer may be determined by the required sensitivity and the required energy resolution. The area of the entrance aperture may affect the number of ions detected per second and may also determine the energy resolution. In addition, in a WTS, the sensitivity may also depend on the ionizing electronic current.

Figure 2A:
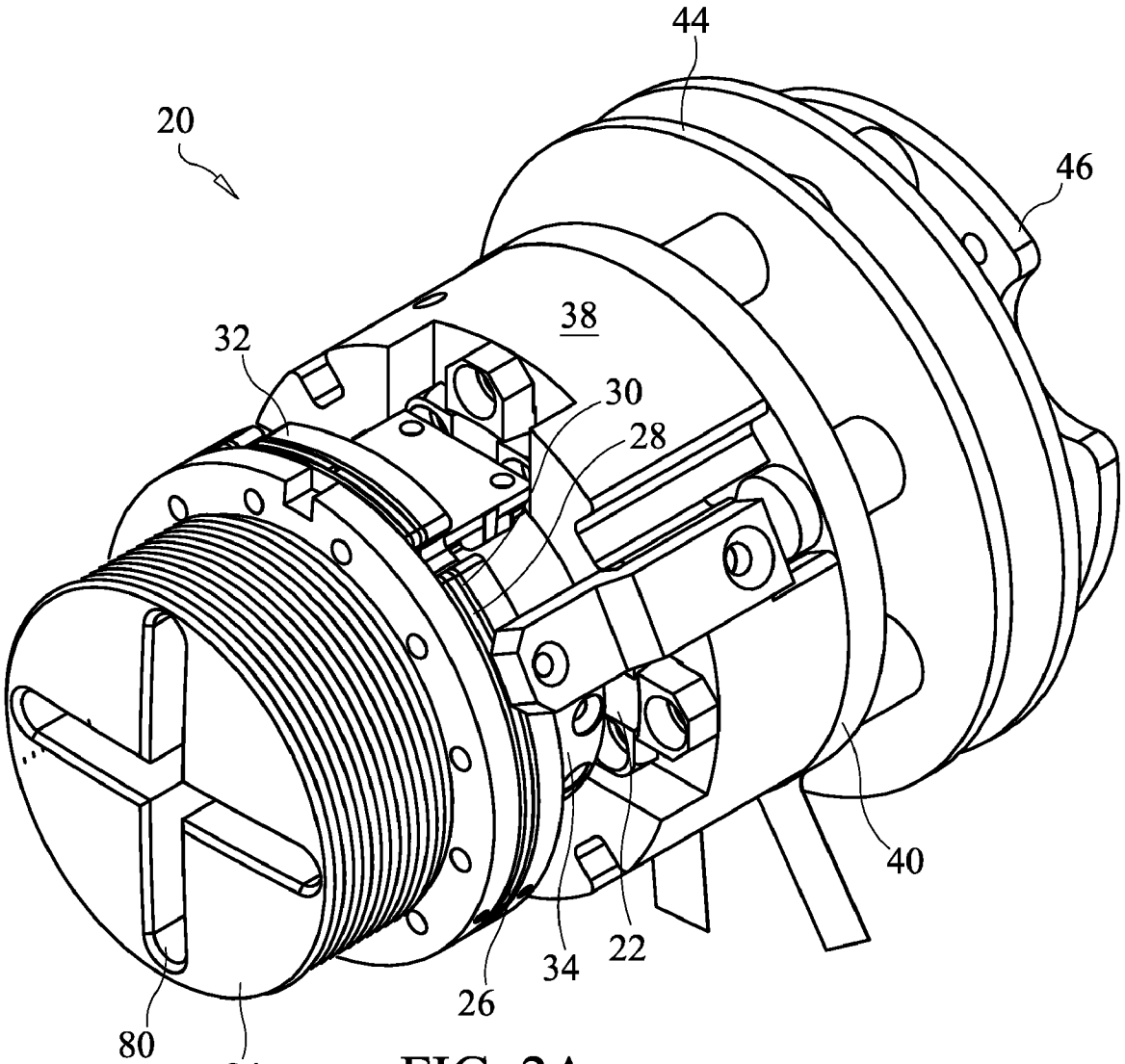
FIGS. 2A and B are perspective and exploded perspective views, respectively, of an embodiment of a WTS having a crossed SDEA.

FIGS. 2A and B are a perspective view, and an exploded perspective view, respectively, of an embodiment of a WTS 20 having a crossed SDEA 22. The WTS may include a spacecraft interface and aperture member 24, a first bias plate insulator 26, a bias plate 28, a second bias plate insulator 30, an ionizer entrance member 32, an ionizer chamber 34 having a single ion source, an ionizer aperture member 36, a crossed SDEA 22, a crossed SDEA pedestal 38, a detector 40 having an anode array 42, an electronics board 44, and a harness interface plate 46. The spacecraft interface and aperture member 24 may include a WTS entrance aperture 80.

Ultraviolet photons, mainly of 121.8 nanometer wavelength, may contaminate the particle signal if they reach the detector 40. The photon flux entering the crossed SDEA 22 may be limited by the entrance aperture 80, the bias plate 28, and the ionizer entrance member 32. Less than one in one thousand of the ultraviolet photons entering the crossed SDEA 22 may reach the detector 40. The interior surfaces, for example, plates 48-62 and exit slit member 64 (see FIG. 4), of the crossed SDEA 22 may be roughened, by, for example, sand-blasting, to help ensure low reflectivity and thereby reduce contamination due to ultraviolet photons.

Figure 4:
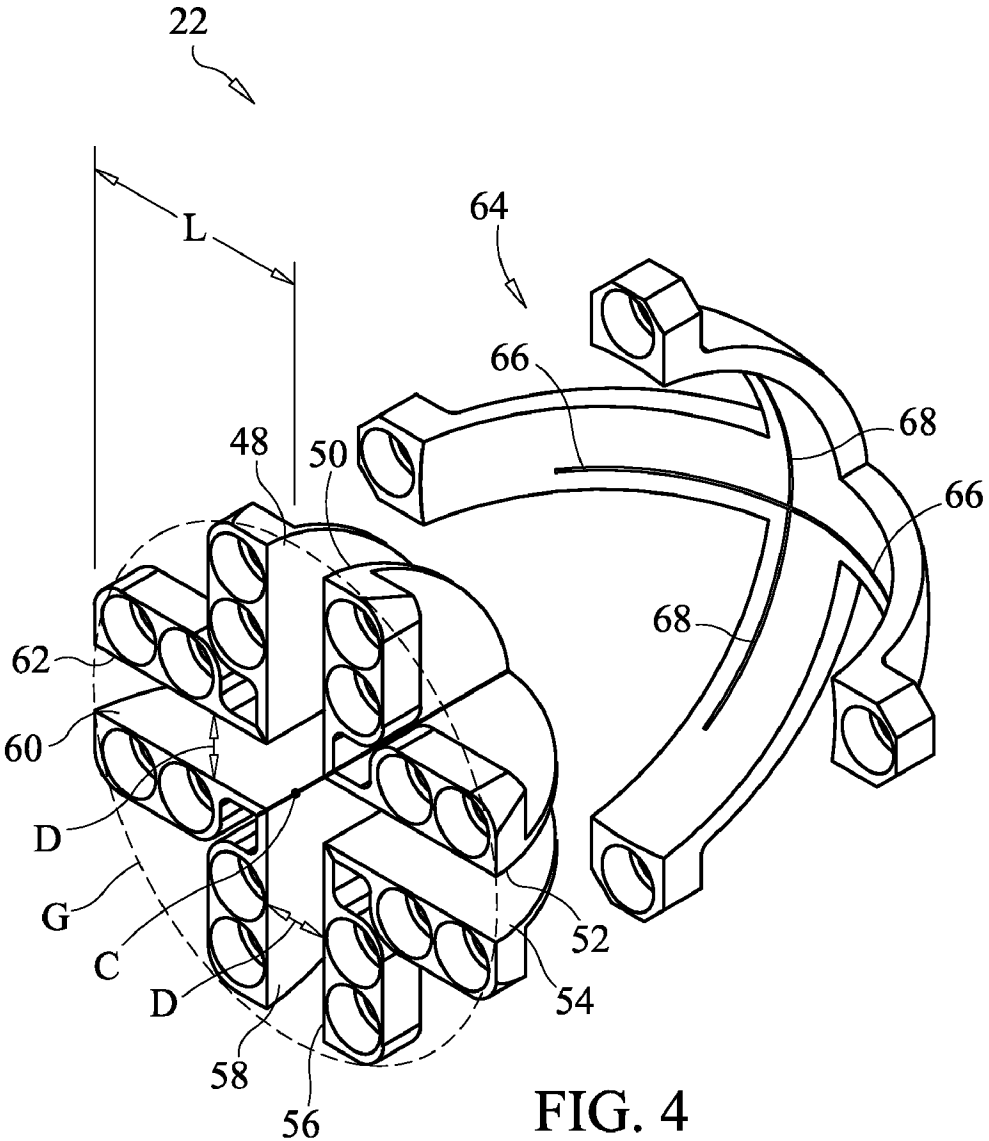
FIG. 4 is an exploded view of the crossed SDEA of FIG. 3.
Figure 3:
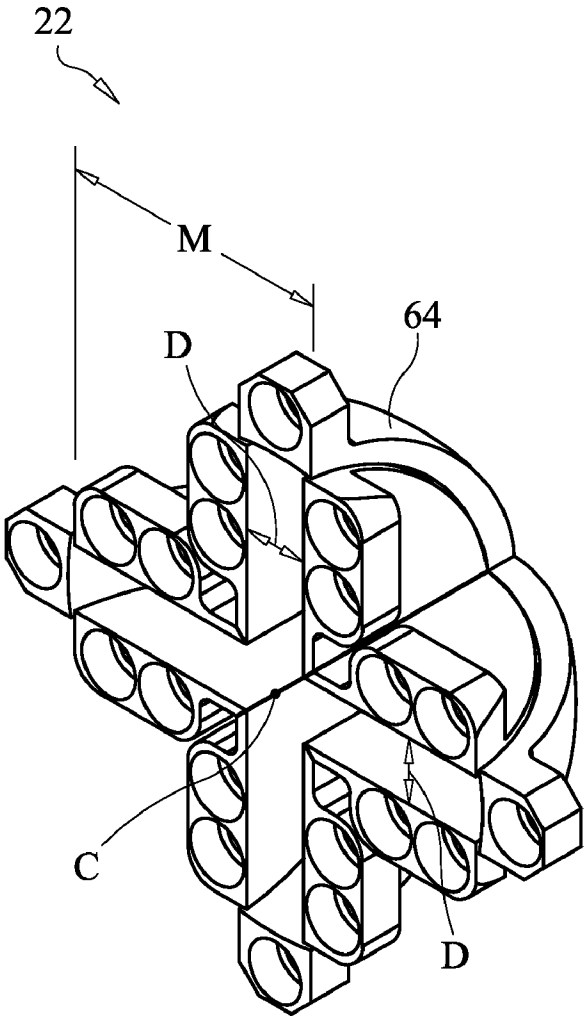
FIG. 3 is an enlarged, perspective view of a crossed SDEA.

FIG. 3 is an enlarged, perspective view of the crossed SDEA 22 and FIG. 4 is an exploded view of the crossed SDEA 22. Crossed SDEA 22 may include eight plates 48, 50, 52, 54, 56, 58, 60, and 62. Plates 48 and 58 may be coplanar. Plates 50 and 56 may be coplanar. Plates 62 and 52 may be coplanar. Plates 60 and 54 may be coplanar. The plane defined by plates 48, 58 may be parallel to the plane defined by plates 50 and 56, and the two planes may be spaced apart a distance D. The plane defined by plates 62 and 52 may be parallel to the plane defined by plates 60 and 54, and the two planes may be spaced apart the distance D. The parallel planes of plates 48, 58 and 50, 56 may be perpendicular to the parallel planes of plates 62, 52 and 60, 54.

The eight plates 48-62 may be defined by the intersection of the above-described two sets of parallel planes with a hemisphere. The hemisphere may include a center C, a great circle G (shown in dashed line in FIG. 4), and a radius L. The two sets of parallel planes are, as described before, perpendicular to each other, and, also, are perpendicular to the plane of the great circle G. In addition, the two sets of parallel planes are arranged symmetrically about the center C of the hemisphere. Thus, a gap of width D in the form of a symmetrical cross is formed by the eight plates 48-62.

An exit slit member 64 may be spaced apart from the curved surfaces of the plates 48-62. The exit slit member 64 may define an exit slit having two curved segments 66, 68. The plane containing curved segment 66 may be perpendicular to the plane containing curved segment 68. Segments 66, 68 may be defined by the intersection of a pair of perpendicular planes with the curved surface of a hemisphere having center C, a great circle that is coplanar with the great circle G, and a radius M (FIGS. 3 and 5) that is greater than the radius L. The plane that contains segment 66 may be parallel to the plane of plates 62, 52 and the plane of plates 60, 54. The plane that contains segment 68 may be parallel to the plane of plates 48, 58 and the plane of plates 50, 56.

Figure 5:
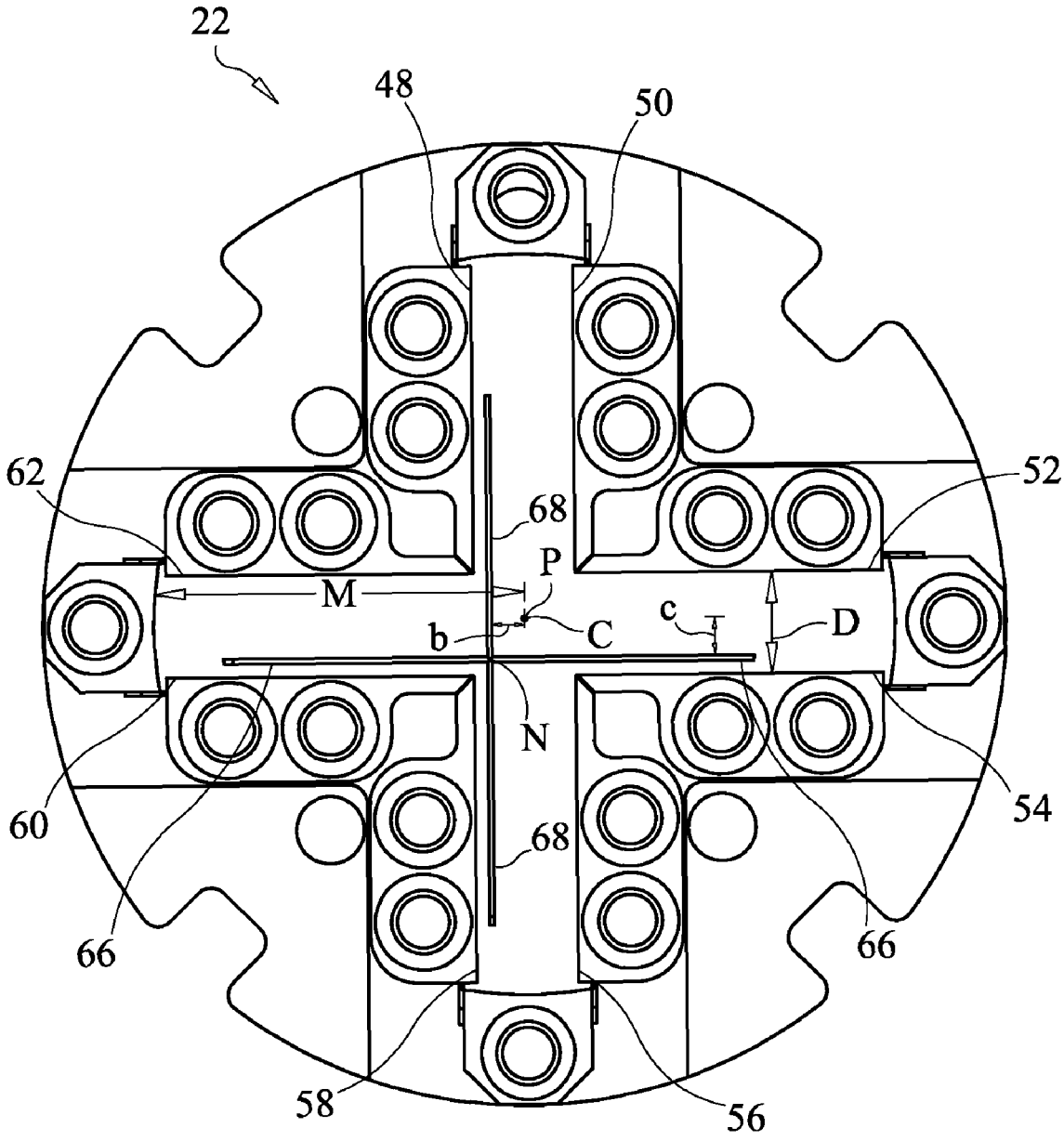
FIG. 5 is a top view of the crossed SDEA of FIG. 4.

FIG. 5 is a top view of the crossed SDEA 22 of FIG. 4. As shown in FIG. 5, the line N of intersection of the pair of perpendicular planes that contain the segments 66, 68 may be parallel to and offset from a line P that contains center C and is normal to the great circle G. In FIG. 5, lines N and P are normal to the plane of the figure. Line N may be offset from line P in two directions. An offset b may be in a direction parallel to segment 66 and an offset c may be in a direction parallel to segment 68. The amount of offset b or c may be less than D/2.

Figure 6:
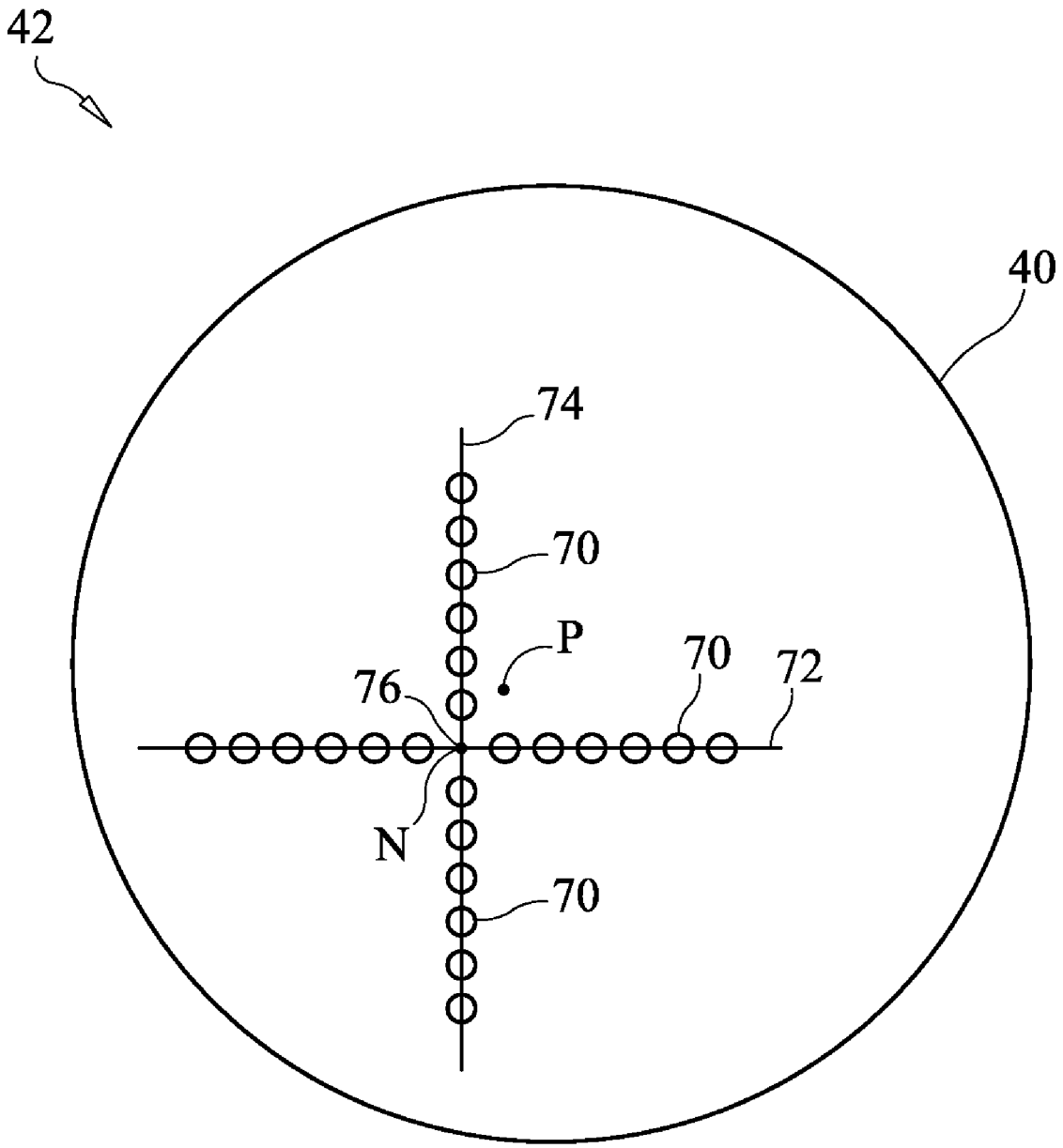
FIG. 6 is a top view of the anode array.

Detector plate 40 (FIG. 2B) may be located adjacent and spaced apart from the exit slit member 64 (FIG. 4). Detector plate 40 may be in a plane that is parallel to the plane of the great circle G (FIG. 4). Detector plate 40 may be a microchannel plate detector. Detector plate 40 may have an anode array 42 located behind it, as shown in FIG. 6. The anode array 42 may include a plurality of anodes 70 arranged along a pair of perpendicular lines 72, 74. The location of the lines 72, 74 and anodes 70 may be defined by the projection of the exit slit segments 66, 68 onto the detector plate 40 in the direction normal to the plane of the great circle G. The intersection 76 of lines 72 and 74 is a point on line N (FIG. 5). Therefore, the anode array 42 may be offset from the center C of the great circle G the same as the exit slit segments 66, 68.

Figure 2B:
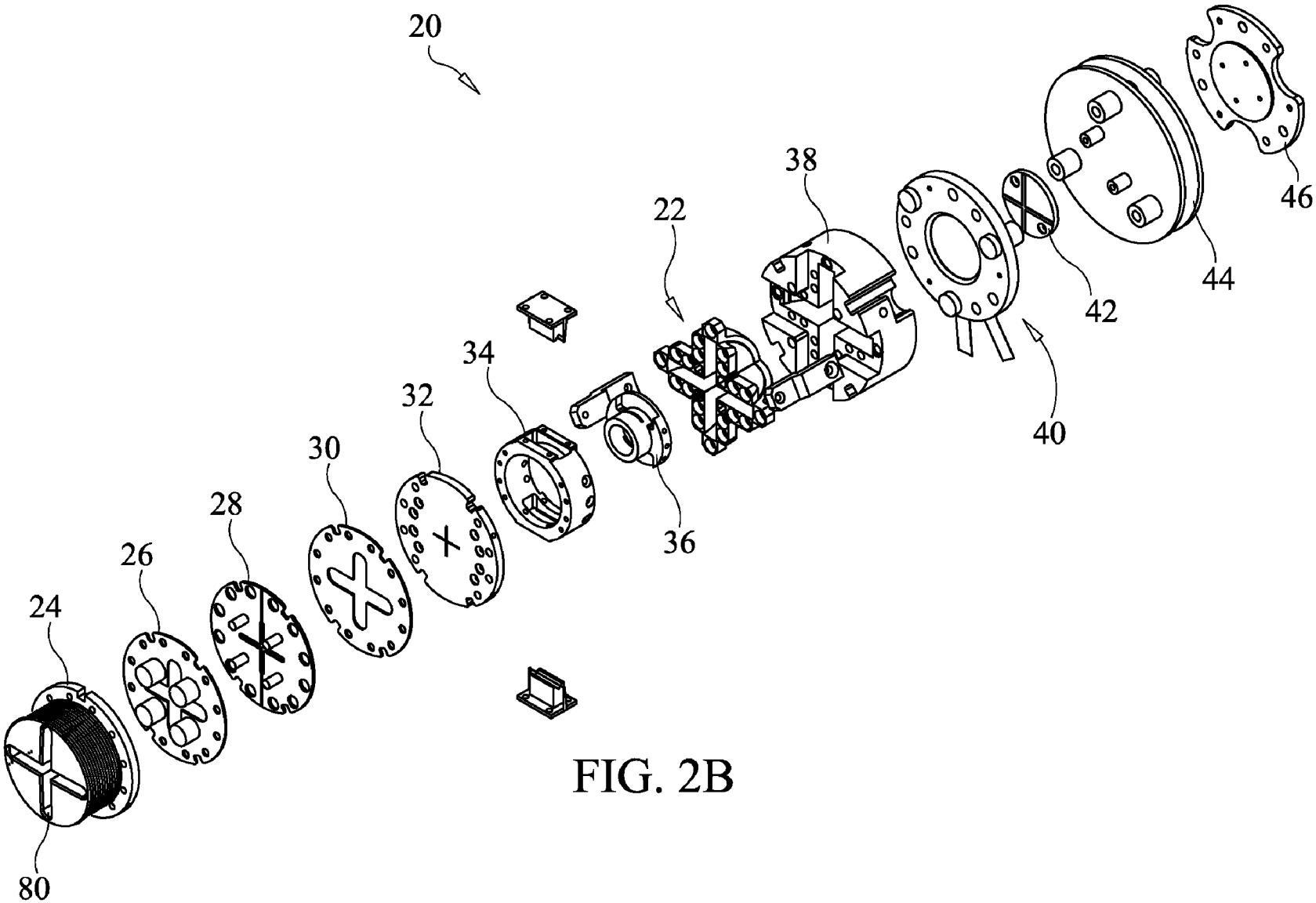
Figure 7:
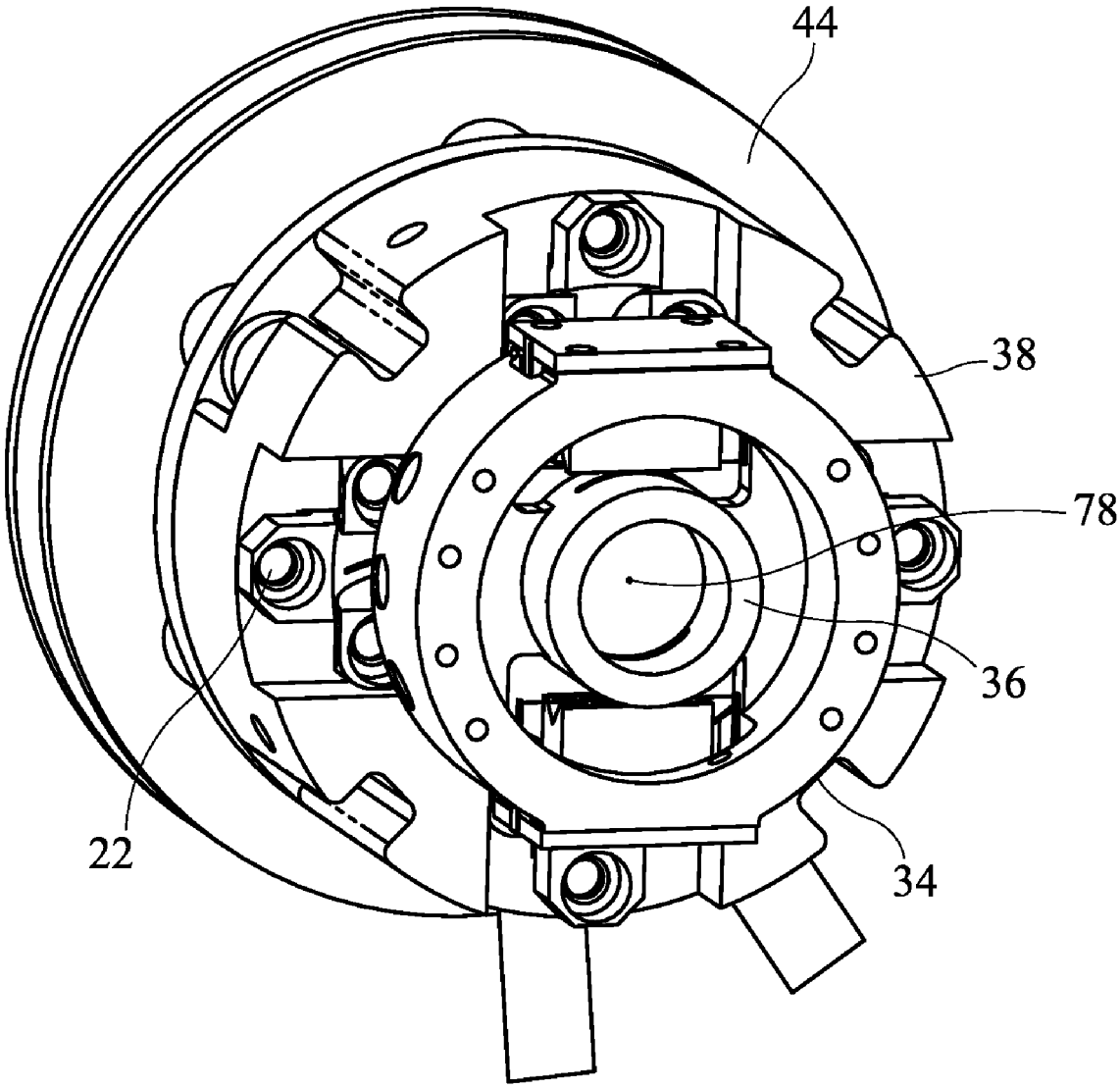
FIG. 7 is a perspective view of a portion of the WTS of FIGS. 2A-B, showing an entrance aperture 78.

FIG. 7 is a perspective view of a portion of the WTS of FIGS. 2A-B, showing an SDEA entrance aperture 78 defined by an aperture member 36 (see also FIG. 2B). Aperture member 36 may be located adjacent the great circle G (FIG. 4). SDEA entrance aperture 78 may be spaced apart from the great circle G and centered on a line that is perpendicular to the great circle G and that intersects the center C of the hemisphere. SDEA entrance aperture 78 may have the shape of, for example, a circle.

Figure 8A:
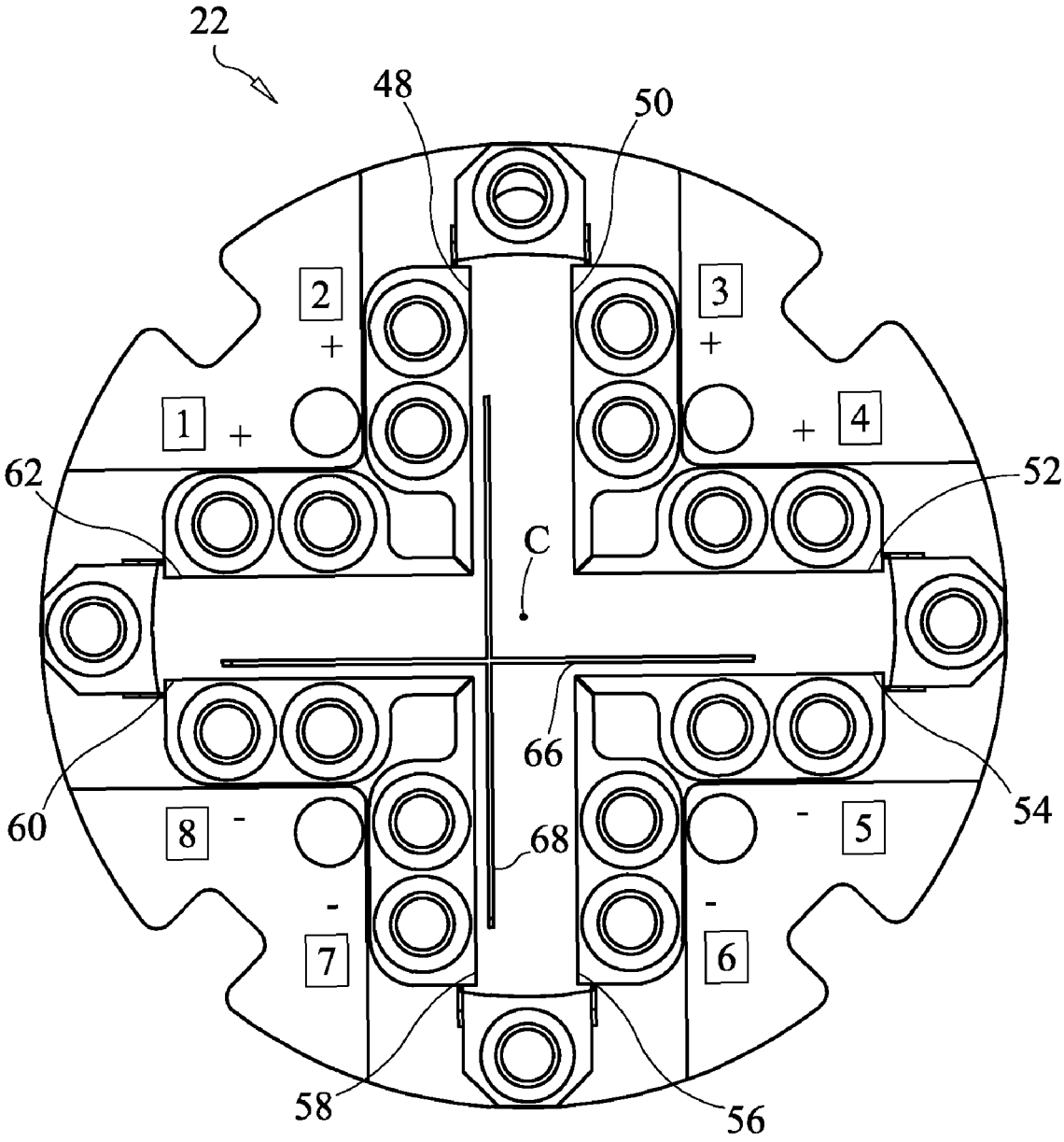
FIGS. 8A and B are top views of the SDEA plates showing exemplary biasing arrangements for alternating the voltage of the plates.
Figure 8B:
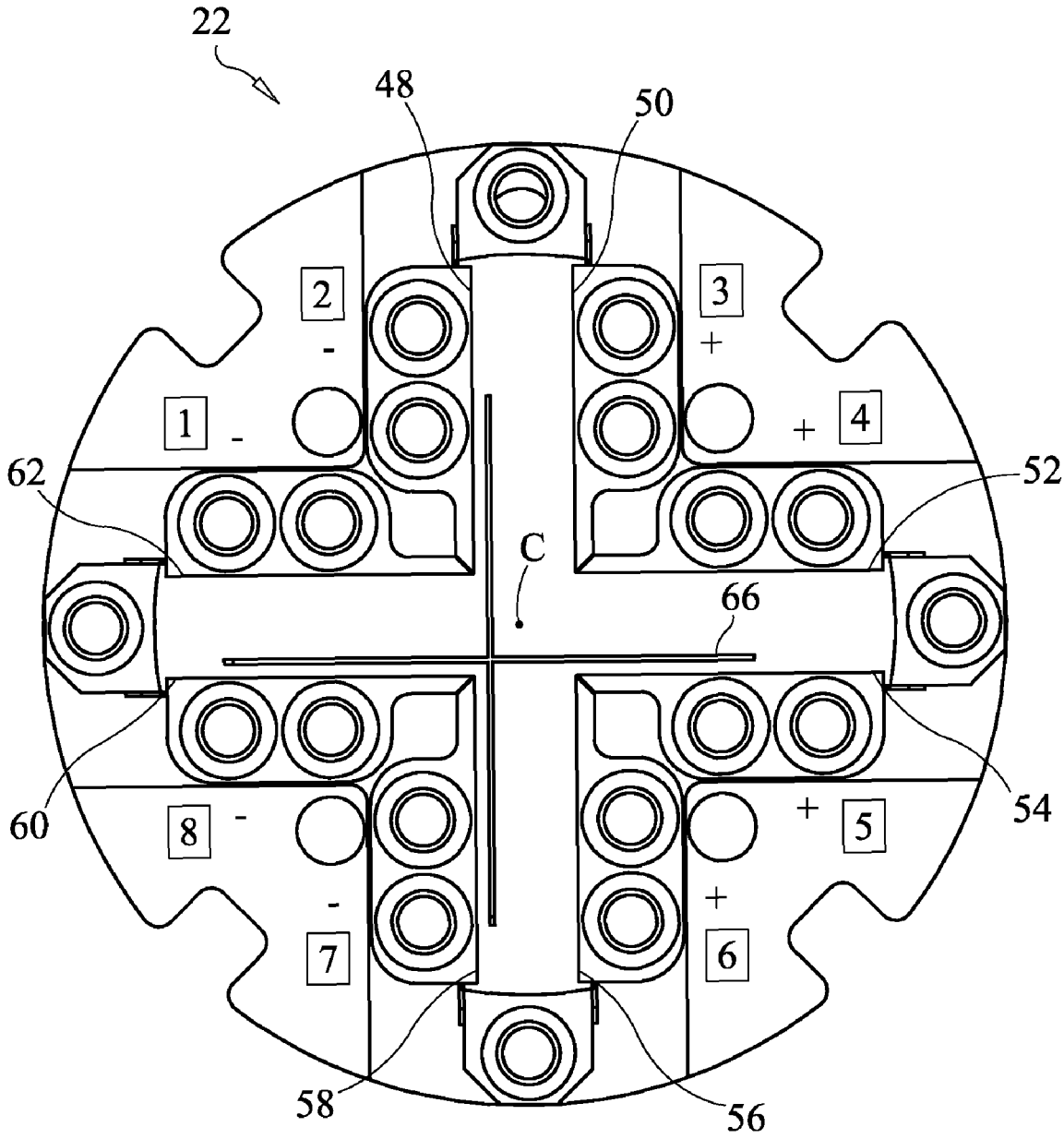

FIGS. 8A and B are top views of the plates 48-62 showing exemplary biasing arrangements for alternating the voltage of the plates 48-62. By alternating the voltage of the plates 48-62, one may alternate the energy and angle analysis of the flux F (FIG. 1) between the two perpendicular planes. In FIG. 8A, plates 48, 50, 62 and 52 may be biased with a positive voltage and plates 54, 56, 58 and 60 may be biased negative (or unbiased, i.e., zero voltage). In FIG. 8A, lines of equal electrostatic potential are located between and parallel to the plane of plates 62 and 52 and the plane of plates 60 and 54. In FIG. 8B, plates 50, 52, 54 and 56 may be biased with a positive voltage and plates 58, 60, 62 and 48 may be biased negative (or unbiased, i.e., zero voltage). In FIG. 8B, lines of equal electrostatic potential are located between and parallel to the plane of plates 48 and 58 and the plane of plates 50 and 56.

Neutral atoms and molecules may enter the WTS through the WTS entrance aperture 80 (FIG. 2B). The neutrals may be ionized in the ionizer chamber 34. The ionized neutrals may enter the SDEA 22 through the SDEA entrance aperture 78 (FIG. 7). The ionized neutrals may be deflected by the electric field between parallel plates of the SDEA 22, as described with reference to FIGS. 8A and 8B. If an ion possesses the proper kinetic energy, the ion may deflect the amount required to pass through one of the exit slit segments 66, 68. Ions that pass through the exit slit segments 66, 68 may then be detected by the anodes 70 of the detector 40.

For angles of incidence at the WTS entrance aperture 80 of less than about 45 degrees, the electric field between the parallel plates of the SDEA 22 may be uniform with a negligible azimuthal component. In the region of the center of the symmetrical cross formed by the eight plates 48-62, the electric field may be weaker than the electric field further away from the center, in the "legs" of the symmetrical cross. Thus, for angles of incidence larger than about five degrees, ion deflection for all trajectories may be similar. For smaller angles of incidence, the trajectories may be measurably different. This effect may be taken into account during calibration of the WTS, to enable proper use of the data. Thus, the two sets of trajectories may be considered as purely perpendicular to the parallel plates of the SDEA 22, thereby preserving the original angle of incidence of the ion at the WTS entrance aperture 80. The location of the anodes 70 of the anode array 42 (FIG. 6) may correspond to discrete angles of incidence at the WTS entrance aperture 80.

The number of ions detected at each of the anodes 70 is a two-dimensional angular distribution of the flux F along two perpendicular planes, as shown by the hatched area in FIG. 1. Knowledge of the two-dimensional angular distribution may allow one to infer the angle of maximum flux F.

Figure 9:
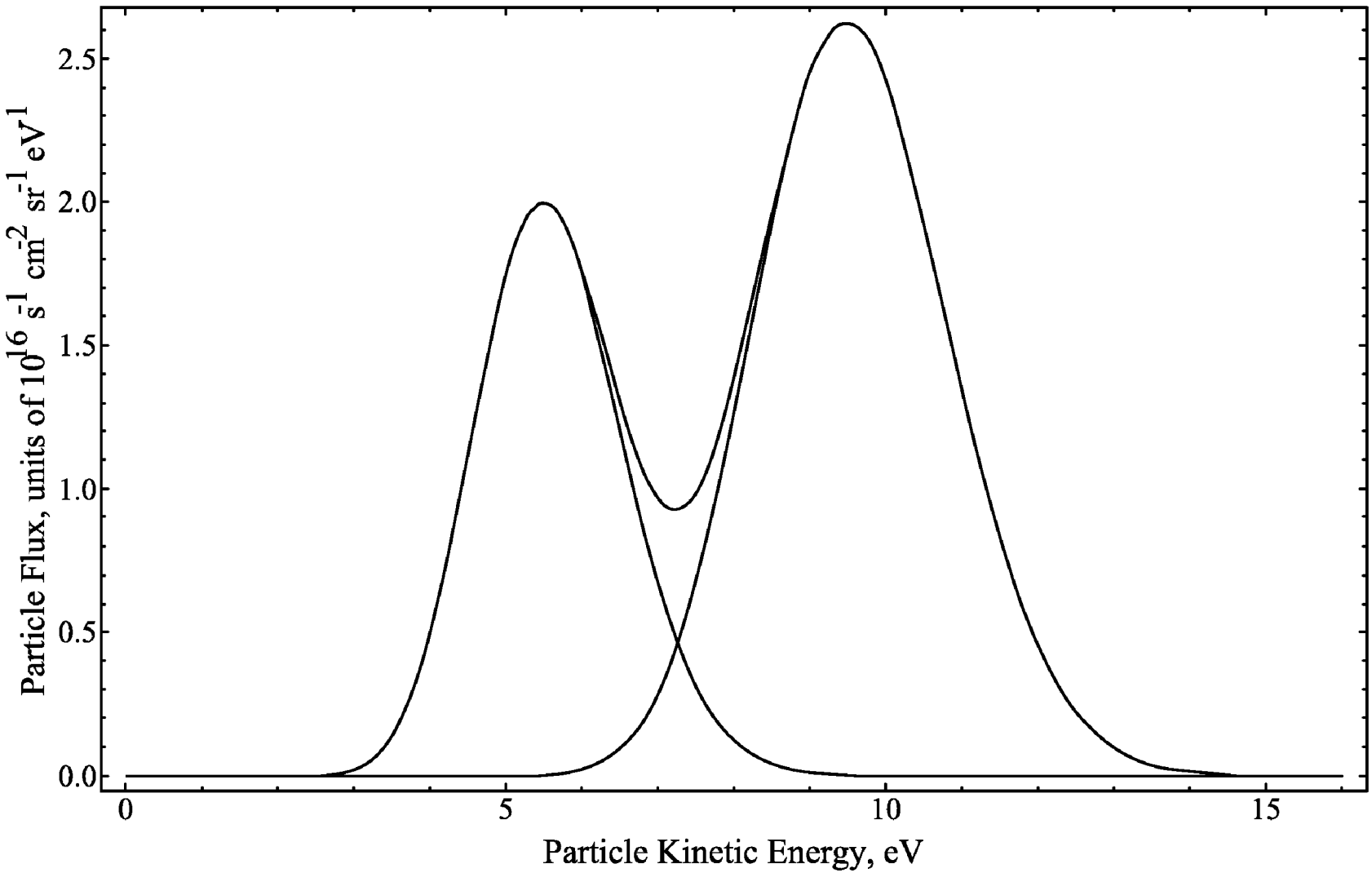
FIG. 9 is a linear plot of ion energy and flux.

The magnitude of the total wind vector W may be obtained by producing an energy spectrum for each point or pixel (tau, theta) of the angular distribution. The energy spectrum may be obtained by scanning or varying the voltage between the respective SDEA plates shown in FIGS. 8A and 8B. For example, fifteen or twenty different voltages may be applied between the respective SDEA plates and the flux at each angular point (tau, theta) measured. FIG. 9 is an exemplary energy spectrum showing flux in units of $10^{16}$ atoms/($cm^2$–sec–sterad–eV) plotted against energy in eV for O (oxygen) and $N_2$ (nitrogen) between 0 and If the identity of the constituents of the incoming flux F is unknown, then another instrument, such as a mass spectrometer, may be used to determine the identity (mass) of the constituents of the incoming flux. Once the masses of the constituents are known, and the energy measured by the WTS 20, the velocity of the wind vector W may be obtained from the kinetic energy equation.

The size and dimensions of the WTS 20 may be scaled for particular applications. The WTS 20 may be mounted in a satellite with its entrance aperture 80 pointed in the direction of satellite motion (ram direction). The satellite velocity S may be about 8000 meters per second and the wind vector W may be in a range of about 0-200 meters per second. The angles of incidence in each perpendicular plane, that is, tau and theta from FIG. 1, may vary between about plus and minus 25 degrees.

In one embodiment, the outer diameter of the WTS 20 may be about 1.5 inches. The WTS 20 may occupy a volume of less than about 40 cubic centimeters.

The SDEA entrance aperture 78 may have a diameter of about 0.008 inches (0.20 mm) to provide the required neutral signal and energy resolution between 0.05 (one part in twenty) and 0.15 (three parts in twenty). The distance from the SDEA entrance aperture 78 to the center C of the great circle G may be about 0.1 D.

The WTS 20 may scan ions having energy in a range of about 0.1 to about 20 eV by applying voltages between 0 to 5 volts to the SDEA plates. The ratio L/D (radius of SDEA/gap between plates) may determine the voltage that must be applied between the SDEA plates to select a particular ion energy.

The difference between the radius L of the SDEA plates and the radius M of the exit slit member 54 may be about 0.05 L. The width of the exit slit segments 66, 68 may be about 0.008 inches. The offsets b, c of the center of the exit slit 66, 68 from the center C may be, for example, about 0.080 inches. Optimum values for the offsets b, c may be determined from ion trajectory calculations, using, for example, a trajectory simulation program such as SIMION. The offsets b, c may be slightly larger than the width of the exit slit segments 66, 68. An exemplary value for b or c may be, for example, about 0.010 inches. The offsets b, c may preferably be as large as possible to achieve deflection that is sufficient for good energy definition and, also, for optimal photon rejection. The number of anodes 70 in each exit slit segment 66, 68 may be about 32.

Thermionic emitters may require heater power of about 100 mW to produce 1 mA of electron beam current. Typically, electron energy may be about 100 eV and may require an additional 100 mW of power for electron acceleration. Thus, ion source power may be about 200 mW. If two ion sources are used, the ion source power may be 400 mW. Detector power, deflection voltage power, and micro-controller and other functions may require less than 150 mW. Thus, a wind and temperature spectrometer with two separate optical axes (two separate ion sources) may consume about 550 mW. However, the presently described WTS 20, with its single ion source and a crossed SDEA, may consume about 350 mW.

With its small size and low power requirement, the crossed SDEA may offer the right size for use in the new nano-satellites and in the newly popular satellite format known as the Cube-Sat. The Cube-Sat satellite may have dimensions of about four inches by four inches by four inches. The power required by the crossed SDEA, for example, less than 0.4 W, may be quite compatible with typical Cube-Sat power budgets of about four W. Despite the small size of the crossed SDEA, thermionic cathodes may provide the needed sensitivity. The crossed SDEA may provide one or more full wind vector determinations per second in low-Earth orbit (about 400 km altitude). Thus, the crossed SDEA offers many advantages in the measurements of neutral wind and ion drifts in the Earth's thermosphere. As such, it may be useful in satellites that monitor the ionosphere, with a view to improving the integrity and predictability of GPS operations.

What is claimed is:

1. A crossed small-deflection energy analyzer (SDEA), comprising:

eight plates defined by an intersection of a first pair of parallel planes spaced apart a distance D with a second pair of parallel planes spaced apart the distance D and a hemisphere having a center and a great circle, the first and second pairs of parallel planes being perpendicular to each other and to the great circle, and arranged symmetrically about the center of the hemisphere;

an aperture member located adjacent and spaced apart from the great circle, the aperture member defining an entrance aperture that is centered on a line that is perpendicular to the great circle and that intersects the center of the hemisphere;

an exit slit member spaced apart from a curved surface of the hemisphere, the exit slit member including an exit slit, the exit slit being defined by an intersection of a pair of perpendicular planes with a curved surface of a second hemisphere that is concentric with the hemisphere, the second hemisphere having a great circle that is coplanar with the great circle of the hemisphere and a radius that is larger than a radius of the hemisphere, one of the pair of perpendicular planes being parallel to the first pair of parallel planes, and a line of intersection of the pair of perpendicular planes being parallel to and offset from a line that contains the center of, and is normal to, the great circle of the hemisphere.

2. The crossed SDEA of claim 1, wherein the line of intersection of the pair of perpendicular planes is offset from the line containing the centers of the hemisphere and the second hemisphere by a distance that is less than D/2.

3. The crossed SDEA of claim 1, further comprising a detector plate located adjacent and spaced apart from the exit slit member, the detector plate being in a plane parallel to the plane of the great circle of the hemisphere.

4. The crossed SDEA of claim 3, wherein the detector plate comprises a microchannel plate detector.

5. The crossed SDEA of claim 4, wherein the detector plate includes an array of anodes arranged along a pair of perpendicular lines, the perpendicular lines being defined by a projection of the exit slit onto the detector plate in a direction normal to the plane of the great circle of the hemisphere.

6. A crossed small-deflection energy analyzer (SDEA), comprising:

eight plates defined by an intersection of a first pair of parallel planes spaced apart a distance D with a second pair of parallel planes spaced apart the distance D and a hemisphere having a center and a great circle, the first and second pairs of parallel planes being perpendicular to each other and to the great circle, and arranged symmetrically about the center of the hemisphere;

an aperture member located adjacent and spaced apart from the great circle, the aperture member defining an entrance aperture that is centered on a line that is perpendicular to the great circle and that intersects the center of the hemisphere;

an exit slit member spaced apart from a curved surface of the hemisphere, the exit slit member including an exit slit, the exit slit being defined by an intersection of a pair of perpendicular planes with a curved surface of a second hemisphere that is concentric with the hemisphere, the second hemisphere having a great circle that is coplanar with the great circle of the hemisphere and a radius that is larger than a radius of the hemisphere, one of the pair of perpendicular planes being parallel to the first pair of parallel planes, and a line of intersection of the pair of perpendicular planes being parallel to and offset from a line that contains the center of, and is normal to, the great circle of the hemisphere; and a detector plate located adjacent and spaced apart from the exit slit member, the detector plate being in a plane parallel to the plane of the great circle of the hemisphere;

wherein the line of intersection of the pair of perpendicular planes is offset from the line containing the centers of the hemisphere and the second hemisphere by a distance that is less than D/2.

7. The crossed SDEA of claim 6, wherein the detector plate includes an array of anodes arranged along a pair of perpendicular lines, the perpendicular lines being defined by a projection of the exit slit onto the detector plate in a direction normal to the plane of the great circle of the hemisphere.

8. A wind and temperature spectrometer (WTS), comprising:

the crossed SDEA of claim 1;

a second aperture member that defines an entrance aperture for the WTS;

a single ion source ionizer chamber disposed downstream of the second aperture member; and a detector plate located adjacent and spaced apart from the exit slit member, the detector plate being in a plane parallel to the plane of the great circle of the hemisphere.

9. The WTS of claim 8, wherein the detector plate includes an array of anodes arranged along a pair of perpendicular lines, the perpendicular lines being defined by a projection of the exit slit onto the detector plate in a direction normal to the plane of the great circle of the hemisphere.

10. A wind and temperature spectrometer (WTS), comprising:

the crossed SDEA of claim 6;

a second aperture member that defines an entrance aperture for the WTS; and a single ion source ionizer chamber downstream of the second aperture member.

11. The WTS of claim 10, wherein the detector plate includes an array of anodes arranged along a pair of perpendicular lines, the perpendicular lines being defined by a projection of the exit slit onto the detector plate in a direction normal to the plane of the great circle of the hemisphere.

12. A method, comprising:

providing the crossed SDEA of claim 5; and detecting angular and energy distributions of ions passing through the crossed SDEA.

13. The method of claim 12, wherein detecting includes detecting in two mutually perpendicular planes.

14. The method of claim 13, further comprising producing the ions using a single ion source ionizer chamber.

15. The method of claim 14, further comprising alternating voltage applied to plates of the SDEA.

16. The method of claim 15, further comprising varying a magnitude of the alternated voltage to produce an energy spectrum.

* * * * *